US010696069B2

(12) United States Patent
Hatakeyama et al.

(10) Patent No.: US 10,696,069 B2
(45) Date of Patent: Jun. 30, 2020

(54) LIQUID DISCHARGE APPARATUS

(71) Applicants: Taku Hatakeyama, Kanagawa (JP); Takashi Watanabe, Kanagawa (JP); Kaoru Tadokoro, Kanagawa (JP); Sho Oyamatsu, Tokyo (JP); Tomohiro Inoue, Kanagawa (JP); Hiroshi Gotou, Kanagawa (JP); Mio Kumai, Tokyo (JP)

(72) Inventors: Taku Hatakeyama, Kanagawa (JP); Takashi Watanabe, Kanagawa (JP); Kaoru Tadokoro, Kanagawa (JP); Sho Oyamatsu, Tokyo (JP); Tomohiro Inoue, Kanagawa (JP); Hiroshi Gotou, Kanagawa (JP); Mio Kumai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/293,699

(22) Filed: Mar. 6, 2019

(65) Prior Publication Data

US 2019/0275811 A1 Sep. 12, 2019

(30) Foreign Application Priority Data

Mar. 12, 2018 (JP) ..... 2018-044812
Oct. 22, 2018 (JP) ..... 2018-198426

(51) Int. Cl.
*B41J 11/00* (2006.01)
*B41J 3/60* (2006.01)
(Continued)

(52) U.S. Cl.
CPC ..... *B41J 11/002* (2013.01); *B41J 3/60* (2013.01); *B41J 13/009* (2013.01);
(Continued)

(58) Field of Classification Search
None
See application file for complete search history.

(56) References Cited

U.S. PATENT DOCUMENTS

2010/0015413 A1* 1/2010 Hayashi ..... C09D 11/322 428/195.1
2010/0141726 A1* 6/2010 Kawakami ..... B41J 11/0015 347/102
(Continued)

FOREIGN PATENT DOCUMENTS

JP 5-155007 6/1993
JP 2007-505764 3/2007
(Continued)

*Primary Examiner* — Erica S Lin
(74) *Attorney, Agent, or Firm* — Oblon, McClelland, Maier & Neustadt, L.L.P.

(57) ABSTRACT

A liquid discharge apparatus includes a conveyance path, a liquid discharge head, and a drying device. A medium is to be conveyed on the conveyance path. The liquid discharge head discharges liquid onto the medium conveyed on the conveyance path. The conveyance path includes a switchback path and an ejection path. The switchback path switches back a conveyance direction of the medium onto which the liquid has been discharged. The ejection path conveys the medium onto which the liquid has been discharged to an ejection port. The drying device dries the medium both on the switchback path and on the ejection path.

17 Claims, 7 Drawing Sheets

(51) Int. Cl.
*B65H 29/12* (2006.01)
*B41J 13/00* (2006.01)

(52) U.S. Cl.
CPC ..... *B41J 13/0045* (2013.01); *B65H 29/125* (2013.01); *B65H 2301/33312* (2013.01); *B65H 2301/517* (2013.01); *B65H 2801/27* (2013.01)

(56) References Cited

U.S. PATENT DOCUMENTS

| | | | |
|---|---|---|---|
| 2011/0234672 | A1 | 9/2011 | Ohtsu et al. |
| 2018/0015737 | A1 | 1/2018 | Harada et al. |

FOREIGN PATENT DOCUMENTS

| | | |
|---|---|---|
| JP | 2011-068485 | 4/2011 |
| JP | 2011-194888 | 10/2011 |
| JP | 2013-144375 | 7/2013 |
| WO | WO2005/025869 A1 | 3/2005 |

* cited by examiner

LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-044812, filed on Mar. 12, 2018, and No. 2018-198426, filed on Oct. 22, 2018, in the Japan Patent Office, the entire disclosure of each of which is incorporated by reference herein.

BACKGROUND

Technical Field

The present disclosure relates to a liquid discharge apparatus.

Related Art

In a liquid discharge apparatus, a configuration is disclosed in which a drying device is disposed on a conveyance path of a medium in order to dry a liquid attached to the medium.

SUMMARY

In an aspect of the present disclosure, there is provided a liquid discharge apparatus that includes a conveyance path, a liquid discharge head, and a drying device. A medium is to be conveyed on the conveyance path. The liquid discharge head discharges liquid onto the medium conveyed on the conveyance path. The conveyance path includes a switchback path and an ejection path. The switchback path switches back a conveyance direction of the medium onto which the liquid has been discharged. The ejection path conveys the medium onto which the liquid has been discharged to an ejection port. The drying device dries the medium both on the switchback path and on the ejection path.

In another aspect of the present disclosure, there is provided a liquid discharge apparatus that includes a conveyance path, a liquid discharge head, and a heating device. A medium is to be conveyed on the conveyance path. The liquid discharge head discharges a liquid onto the medium conveyed on the conveyance path. The conveyance path includes a switchback path and an ejection path. The switchback path switches back a conveyance direction of the medium onto which the liquid has been discharged. The ejection path conveys the medium onto which the liquid has been discharged to an ejection port. The heating device faces the switchback path and the ejection path, to heat the medium onto which the liquid has been discharged.

In still another aspect of the present disclosure, there is provided a liquid discharge apparatus that includes a conveyance path, a liquid discharge head, and a blower. A medium is to be conveyed on the conveyance path. The liquid discharge head discharges a liquid onto the medium conveyed on the conveyance path. The conveyance path includes a switchback path and an ejection path. The switchback path switches back a conveyance direction of the medium onto which the liquid has been discharged. The ejection path conveys the medium onto which the liquid has been discharged to an ejection port. The blower faces the switchback path and the ejection path, to blow gas to the medium onto which the liquid has been discharged.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
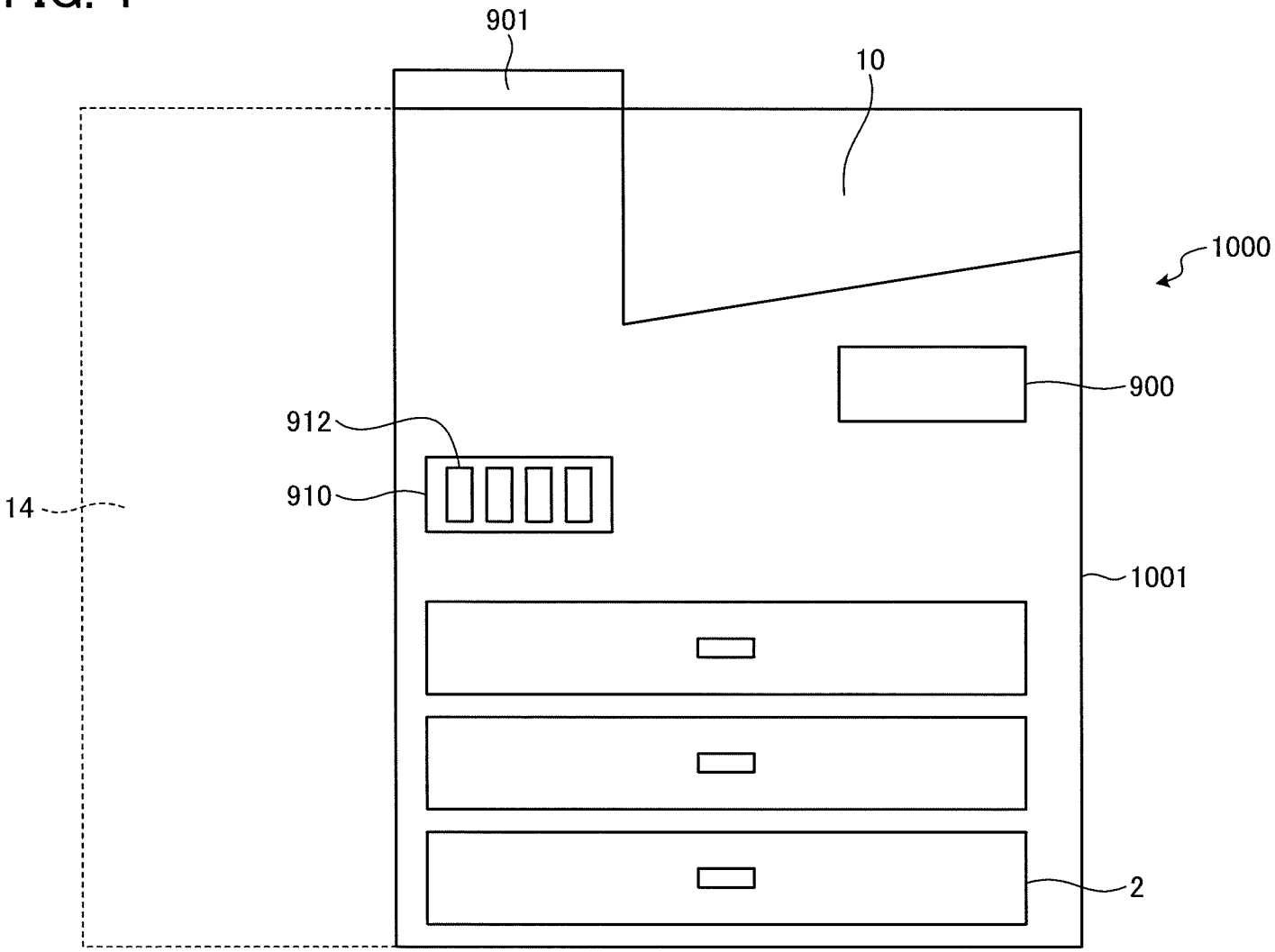
FIG. 1 is an overall schematic view of a liquid discharge apparatus (image forming apparatus)

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components)

having the same function or shape and redundant descriptions thereof are omitted below.

First Embodiment

An outline of a liquid discharge apparatus (image forming apparatus) 1000 will be described with reference to FIGS. 1 and 2. The liquid discharge apparatus 1000 includes an apparatus main body 1001, a sheet feeding tray 2, a sheet ejecting tray 10, an operation unit 900, an auto document feeder (ADF) 901, a cartridge holder 910, a cartridge 912, and a post-treatment device 14.

The sheet feeding tray 2 stores a sheet P (medium). The sheet ejecting tray 10 is an ejection destination of a sheet P on which an image or the like is formed by a liquid discharge head described later. The operation unit 900 includes a touch panel, a physical button, and the like, and a user can instruct the apparatus main body 1001 to perform printing or the like via the operation unit 900. The ADF 901 is a so-called scanner device.

The cartridge 912 is a liquid container containing a liquid (ink or the like) discharged by a liquid discharge head, and is mounted on the cartridge holder 910. A liquid in the cartridge 912 is fed to a liquid discharge head via a tube or the like. The post-treatment device 14 collects sheets with a stapler or folds a sheet.

Figure 2:
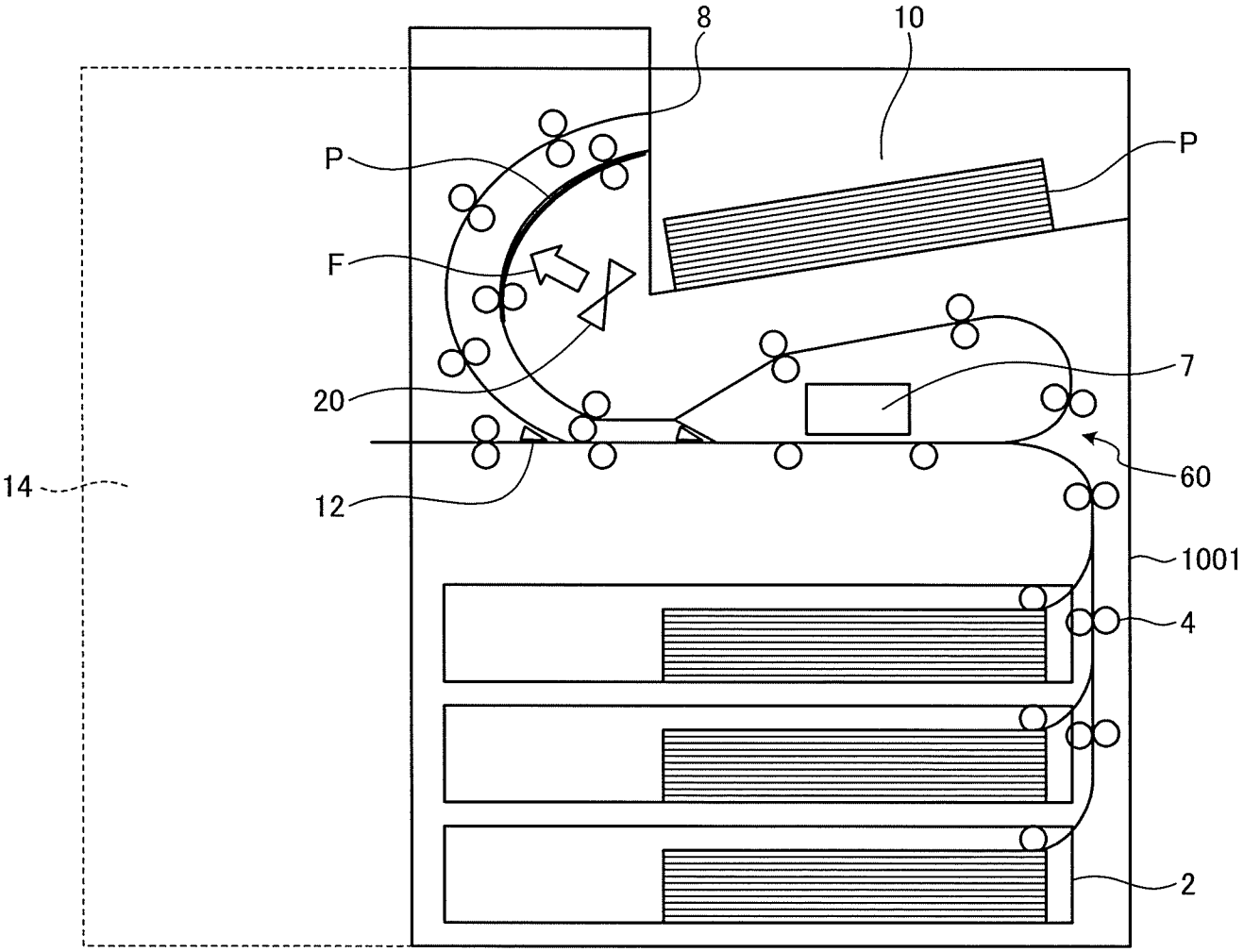
FIG. 2 is an internal schematic view of a liquid discharge apparatus (image forming apparatus)

FIG. 2 is a view illustrating an internal configuration of the apparatus main body 1001. The apparatus main body 1001 includes a conveying roller 4, a conveyance path 60, a drying device 20, a liquid discharge head 7, an ejection port 8, and a switcher 12.

The conveying roller 4 is a roller for conveying a sheet P on the sheet feeding tray 2 or the conveyance path 60 in a conveyance direction. The conveying roller 4 includes a plurality of rollers some of which are rotatable by a driving source such as a motor and others of which are only fitted into bearings without a driving force (these are not distinguished from each other in the present embodiment)

The conveyance path 60 is a path for conveying a sheet P on the sheet feeding tray 2, and is configured such that the sheet P is ejected from the ejection port 8 after sheet P passes below the liquid discharge head 7. The drying device 20 is a device for drying a sheet P conveyed on the conveyance path 60, and specific examples thereof include an air blowing device. Details of the conveyance path 60 and the drying device 20 will be described later with reference to FIGS. 3 and 4.

The liquid discharge head 7 is a portion for discharging a liquid onto a sheet P on the conveyance path 60, and it is possible to use a piezo type inkjet head using a piezoelectric element, a thermal type inkjet head using heat, or the like. In the present embodiment, a so-called line type inkjet head (or a one pass type inkjet head) in which a plurality of the liquid discharge heads 7 is arranged in a direction intersecting with a conveyance direction of a sheet P is used.

The switcher 12 is a claw for switching the conveyance direction of a sheet P, and guides a sheet P onto which a liquid has been discharged to the post-treatment device 14, guides the sheet P to the ejection port 8, or guides the sheet P to a switchback path 61 described later.

Next, the conveyance path 60 and a method for drying a sheet P according to the present embodiment will be described in more detail with reference to FIGS. 3 and 4.

Figure 3:
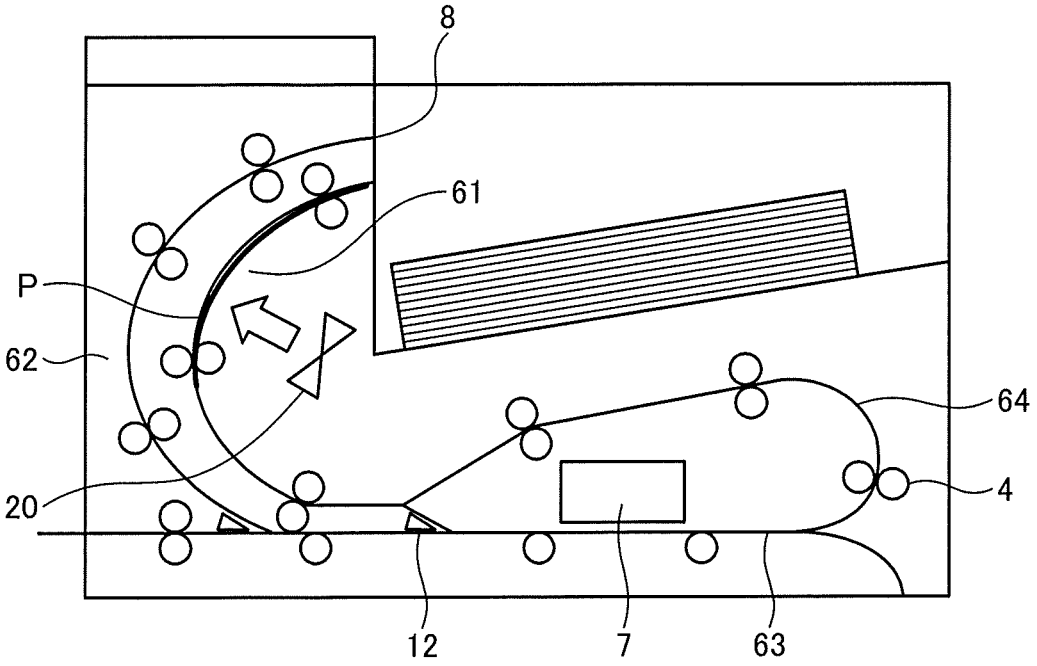
FIG. 3 is a detailed explanatory view of a conveyance path and a peripheral configuration thereof in a first embodiment.
Figure 4:
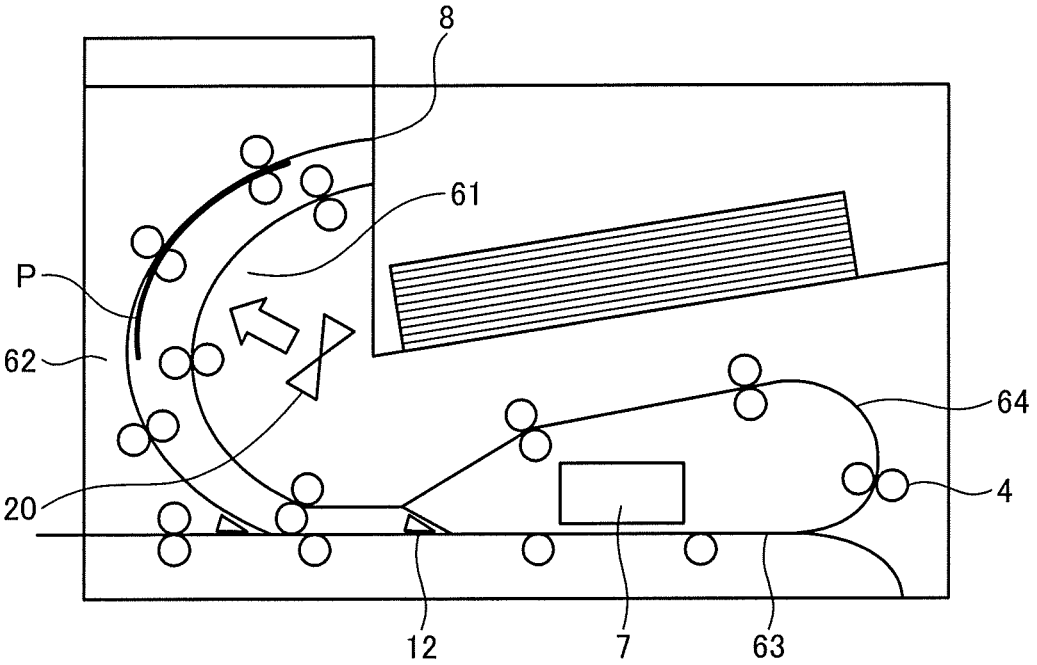
FIG. 4 is a detailed explanatory view of a conveyance path and a peripheral configuration thereof in the first embodiment.

FIGS. 3 and 4 are enlarged views of the conveyance path 60 and a periphery thereof in FIG. 2. The conveyance path 60 includes the switchback path 61, an ejection path 62, a head upper path 64, and a discharge path 63. The switchback path 61 is a path for switching back a conveyance direction of a sheet P onto which a liquid has been discharged.

When a sheet P is reversed, the switcher 12 located at a downstream side of the liquid discharge head 7 in a conveyance direction of the sheet P is operated to guide the sheet P onto which a liquid has been discharged to the switchback path 61. After the sheet P reaches the vicinity of an end portion of the switchback path 61 (near the ejection port 8), for example, driving of the conveying roller 4 is reversed to convey the sheet P to an upstream side.

Thereafter, the sheet P is conveyed to the discharge path 63 via the head upper path 64 above the liquid discharge head 7. As described above, it is possible to switch back the conveyance direction of the sheet P. By this operation, it is possible to reverse the front and back sides of the sheet P, and to discharge a liquid onto the back side of the sheet P.

After discharge of a liquid onto one side or both sides of the sheet P is completed, the sheet P is guided to the ejection path 62 (FIG. 4). The ejection path 62 is a path connecting the liquid discharge head 7 to the ejection port 8, and the sheet P is ejected from the ejection port 8 to the sheet ejecting tray 10.

In the present embodiment, the sheet ejecting tray 10 is disposed above the liquid discharge head 7 in the vertical direction. Therefore, the ejection path 62 is curved (warped) so as to be separated from the liquid discharge head 7 from a downstream side of the liquid discharge head 7 to the ejection port 8. Furthermore, the switchback path 61 is disposed so as to be adjacent to (so as to be along) the ejection path 62.

As a result, the switchback path 61 and the ejection path 62 can be housed in a small space.

In the vicinity of the conveyance path 60, the above-described drying device 20 (drying unit) is disposed. Specifically, the drying device 20 is disposed at a position facing the switchback path 61 and the ejection path 62. The drying device 20 is a device for drying a liquid attached to a sheet P, and examples thereof include a device for rotating a fan or the like and feeding air to dry a liquid and a device for heating and drying a sheet P with a heating portion such as a heating unit. Of course, a combination thereof may be used. The drying unit also includes a curing unit for curing a liquid using a UV lamp or the like. In the present embodiment, the drying device 20 is an air blowing device (blower) for feeding air by rotating a fan.

Here, the drying device 20 dries a sheet P on the switchback path 61 and a sheet P on the ejection path 62. In other words, the drying device 20 is disposed so as to be able to dry a sheet P on the switchback path 61 and a sheet P on the ejection path 62. More specifically, the switchback path 61 and the ejection path 62 are disposed in an air blowing direction by the drying device 20 (or a heating energy irradiation direction by the heating portion, here, collectively referred to as a drying energy supply direction F).

As a result, drying energy by the drying device 20 is supplied to both a sheet P located on the switchback path 61 and a sheet P located on the ejection path 62. Therefore, a range in which a sheet P can receive the drying energy can be expanded on the conveyance path 60, and drying efficiency can be improved.

In the present embodiment, the switchback path 61 is disposed closer to the drying device 20 than the ejection path 62 in the drying energy supply direction F by the drying device 20. In other words, the drying device 20 is disposed so as to face the ejection path 62 across the switchback path 61. As a result, a sheet P conveyed to the switchback path 61 at the time of double-sided printing can be immediately dried, and drying can be performed more efficiently.

Incidentally, it has been found that a liquid which has landed on a sheet P permeates the sheet P and swells mainly a liquid discharge surface side of the sheet P in the course of the penetration to curl the sheet P such that the liquid discharge surface side protrudes.

Therefore, in the present embodiment, as illustrated in FIG. 3 and the like, the switchback path 61 and the ejection path 62 are bent so as to protrude in the drying energy supply direction F by the drying device 20 (such that a downstream side of the drying energy supply direction F protrudes), and conveyance is performed while the liquid discharge surface side of a sheet P is bent inward (in a case of double-sided printing, a surface onto which a liquid has been discharged last is the liquid discharge surface). That is, the switchback path 61 conveys a sheet P such that the liquid discharge surface of the sheet P faces the drying device 20. Similarly, the ejection path 62 conveys a sheet P such that the liquid discharge surface of the sheet P faces the drying device 20. As a result, the drying energy from the drying device 20 is supplied to the liquid discharge surface side of a sheet P.

In addition, as a result, a sheet P to be curled such that the liquid discharge surface side protrudes is bent (warped) in the opposite direction to correct curl of the sheet P. Then, while the curl is corrected, the drying energy is supplied to the liquid discharge surface side to further correct the curl.

Incidentally, it has been found that the amount of the curl of the sheet P described above is larger as the water content in a liquid (ink) is higher. On the contrary, in the first place, the amount of the curl of an ink not having a very high water content (for example, an ink having a water content of about 20% by mass) is small. Therefore, if the present embodiment is combined therewith, curl in the opposite direction may be formed under some conditions (this does not mean to eliminate a possibility of combination). In particular, in a case when the curvature of the switchback path 61 is large, an influence of the curl in the opposite direction is significant.

Therefore, in the present embodiment, it is particularly preferable to use an ink having a water content of 50% by mass or more. By combining an ink having a water content of 50% by mass or more with the present embodiment, it is possible to achieve both discharge of an ink having a high water content and suppression of curl. Since the viscosity of an ink having a water content of 50% by mass or more is low, for example, discharge of a liquid by the liquid discharge head 7 is stable (discharge at a high frequency is possible, for example) advantageously.

As illustrated in FIG. 3 and the like, not only the switchback path 61 but also the ejection path 62 is bent so as to protrude in the drying energy supply direction F by the drying device 20. As a result, the curl in the opposite direction as described above can be reduced also on the ejection path 62.

Second Embodiment

Figure 5:
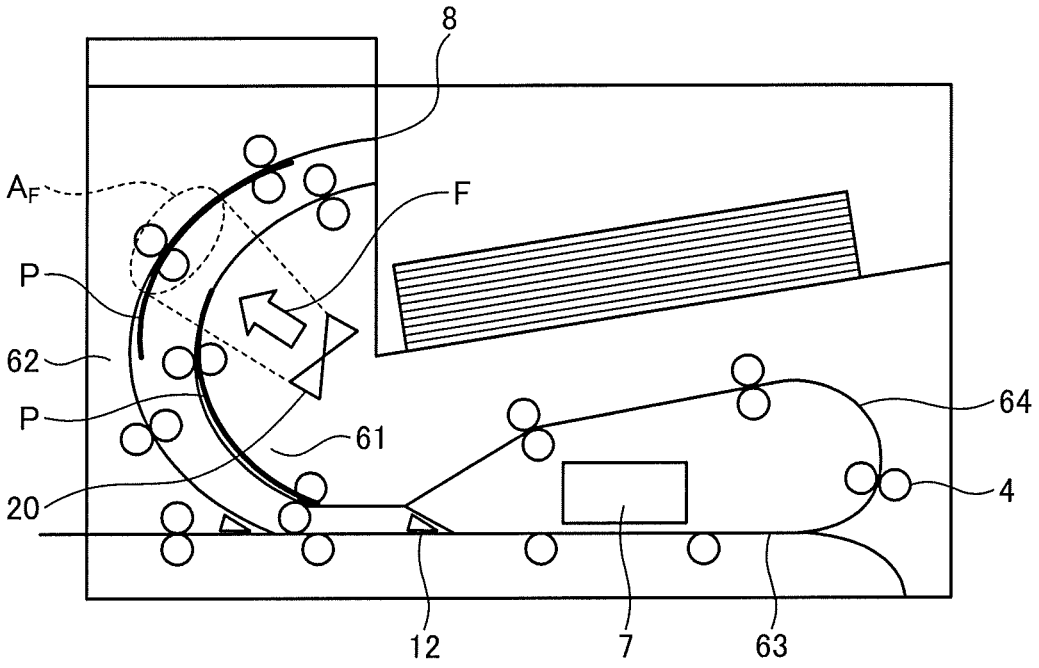
FIG. 5 is a detailed explanatory view of a conveyance path and a peripheral configuration thereof in a second embodiment.

Next, a second embodiment will be described with reference to FIG. 5. FIG. 5 is a schematic view of an apparatus main body when printing is performed on a plurality of sheets.

For example, when a user instructs an apparatus main body 1001 to perform printing on a plurality of sheets, it is estimated that a plurality of sheets P is simultaneously located on a conveyance path 60. In this case, when a sheet P is located in a range (referred to as a supply range Af) to which drying energy by a drying device 20 is supplied on an ejection path 62, if a sheet P located on a switchback path 61 covers the supply range Af (in other words, if a sheet P overlaps with a supply line of drying energy), the sheet P on the ejection path 62 cannot be efficiently dried.

Therefore, in the present embodiment, when a sheet P (first medium) is located in the supply range Af of the ejection path 62, a sheet P (second medium) to be conveyed on the switchback path 61 does not cover the whole of the supply range Af as viewed from the drying device 20. Note that "not covering the whole" includes, as illustrated in FIG. 5, a form in which a sheet P (second medium) conveyed on the switchback path 61 covers a part of the supply range Af as viewed from the drying device 20, and a form in which a sheet P (second medium) conveyed on the switchback path 61 does not cover the supply range Af at all as viewed from the drying device 20.

Specifically, by adjusting the driving amount of a conveying roller 4 and adjusting distances on the switchback path 61 and the ejection path 62 to adjust the conveyance amount of a sheet, the above-described conveying method is possible.

This reduces a phenomenon that the drying energy does not reach a sheet P on the ejection path 62 because the drying energy is blocked by a sheet P on the switchback path 61. Therefore, drying can be performed more efficiently. Incidentally, in order to further improve the drying efficiency, when a sheet P (first medium) is located in the supply range Af of the ejection path 62, preferably, a sheet P (second medium) to be conveyed on the switchback path 61 does not overlap with the supply range Af at all as viewed from the drying device 20. However, in a case where conveying is performed such that a sheet P (second medium) to be conveyed on the switchback path 61 does not overlap with the supply range Af at all, it may take a long conveyance time. Therefore, as illustrated in FIG. 5, a sheet P on the switchback path 61 may cover a part of the supply range Af as viewed from the drying device 20 to receive a part of supply energy. In this way, it is possible to achieve both shortening of printing time and rise in drying efficiency of a sheet.

In addition, in a case of using an air blowing device as the drying device 20, movement of air is less likely to go around a sheet P as compared with movement of heat or the like. Therefore, an effect of raising the drying efficiency according to the present embodiment is large.

Note that the "supply range" can be reworded to "air blowing range" or "wind receiving range" in a case where the drying device 20 is an air blowing device, the "supply range" can be reworded to "irradiation range" or "heating range" in a case where the drying device 20 is a heating device, and the "supply range" can be reworded to "irradiation range" or the like in a case where the drying device 20 is a curing ray irradiation device such as a UV lamp, and the configuration thereof is not limited.

The air blowing range (wind receiving range) on the ejection path 62 is defined by comparing a wind speed on the switchback path 61 with a wind speed on the ejection path 62. Specifically, if a wind speed at a portion where the wind speed is maximum on the switchback path 61 is taken as 100%, a range in which a wind speed of 1% or more is obtained on the ejection path 62 is defined as the air blowing range.

The irradiation range (heating range) on the ejection path 62 is defined by comparing the temperature on the switchback path 61 with the temperature on the ejection path 62. Specifically, if the temperature rising amount (maximum value at a certain portion) of a sheet P on the switchback path 61 when the sheet P is warmed for 10 seconds is taken as 100%, a range in which the temperature rising amount of a sheet P on the ejection path 62 when the sheet P is warmed for 10 seconds is 1% or more is defined as the air blowing range. Note that a sheet may be burned depending on a material of the sheet or an output of a heating unit. Therefore, in this case, the heating time is shortened to five seconds or the like, and the range can be similarly defined.

Third Embodiment

Figure 6:
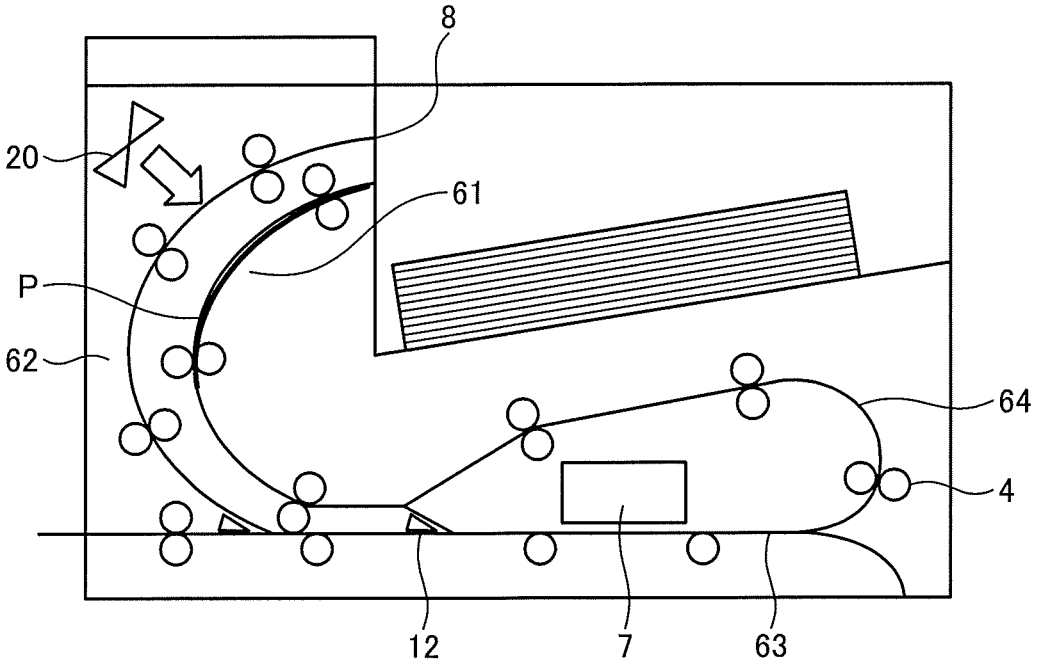
FIG. 6 is a detailed explanatory view of a conveyance path and a peripheral configuration thereof in a third embodiment.
Figure 7:
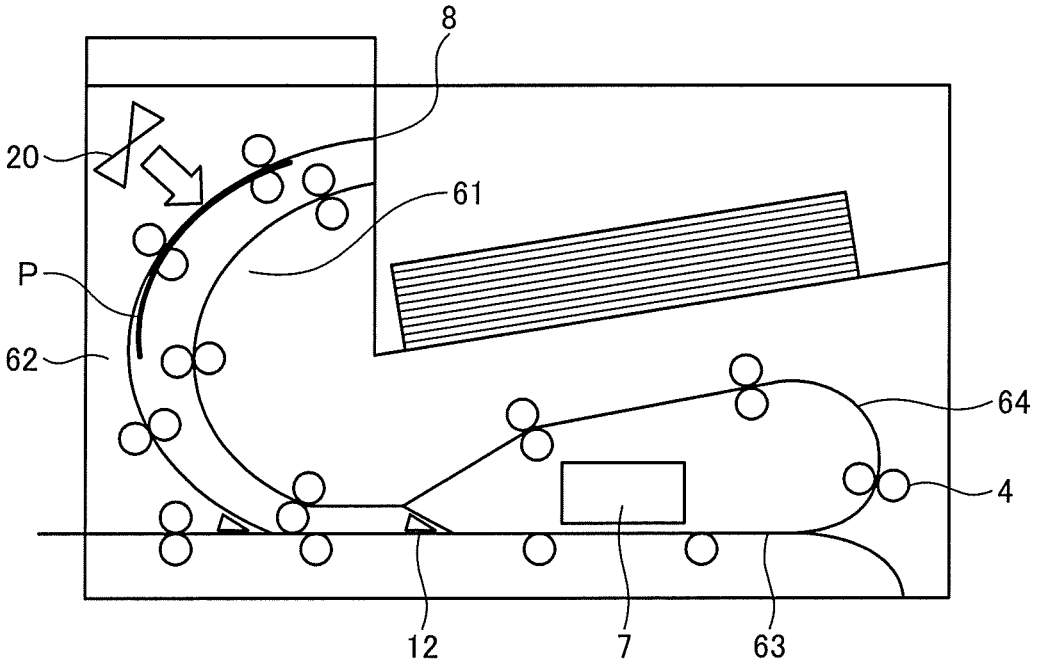
FIG. 7 is a detailed explanatory view of a conveyance path and a peripheral configuration thereof in the third embodiment.

Next, a third embodiment will be described with reference to FIGS. 6 and 7.

In the present embodiment, disposition of a drying device 20 is different from each of the above-described embodiments. Specifically, the drying device 20 is disposed on a side facing a switchback path 61 across an ejection path 62, and supplies drying energy toward the opposite side to a liquid discharge surface side of a sheet P (that is, the back side).

In a case where a large amount of liquid is attached to a sheet P, if strong wind is blown onto the liquid in a state where the liquid is not completely dried immediately after printing, the liquid may move to deteriorate printing quality. In such a case, the present modification is effective, and it is possible to prevent the movement of the liquid by drying the liquid from the back side.

Fourth Embodiment

Figure 8:
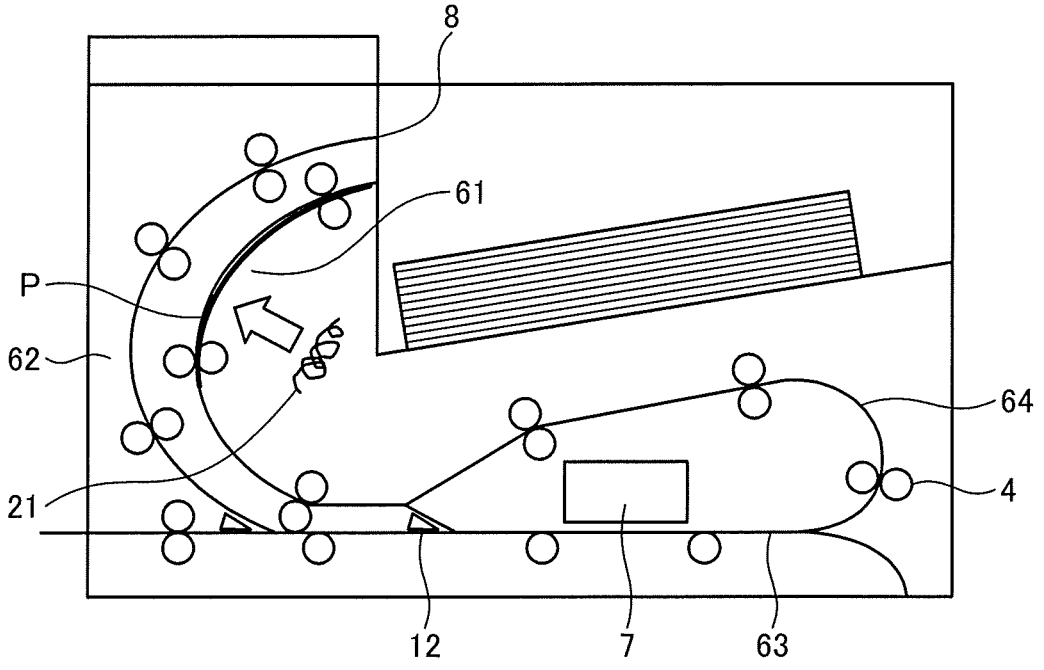
FIG. 8 is a detailed explanatory view of a conveyance path and a peripheral configuration thereof in a fourth embodiment.

Next, a fourth embodiment will be described with reference to FIG. 8.

In the present embodiment, a heating device 21 is used in place of the drying device 20 in each of the above-described embodiments. The heating device 21 includes, for example, a heat transfer heating unit. Much drying energy by the heating device 21 becomes thermal energy. Therefore, heat can be transferred via components (for example, plastic) constituting a switchback path 61. Therefore, as compared with an air blowing device using a fan, drying energy easily reaches a back side of the switchback path 61 (that is, the side of an ejection path 62), and drying can be performed more efficiently.

Fifth Embodiment

Figure 9:
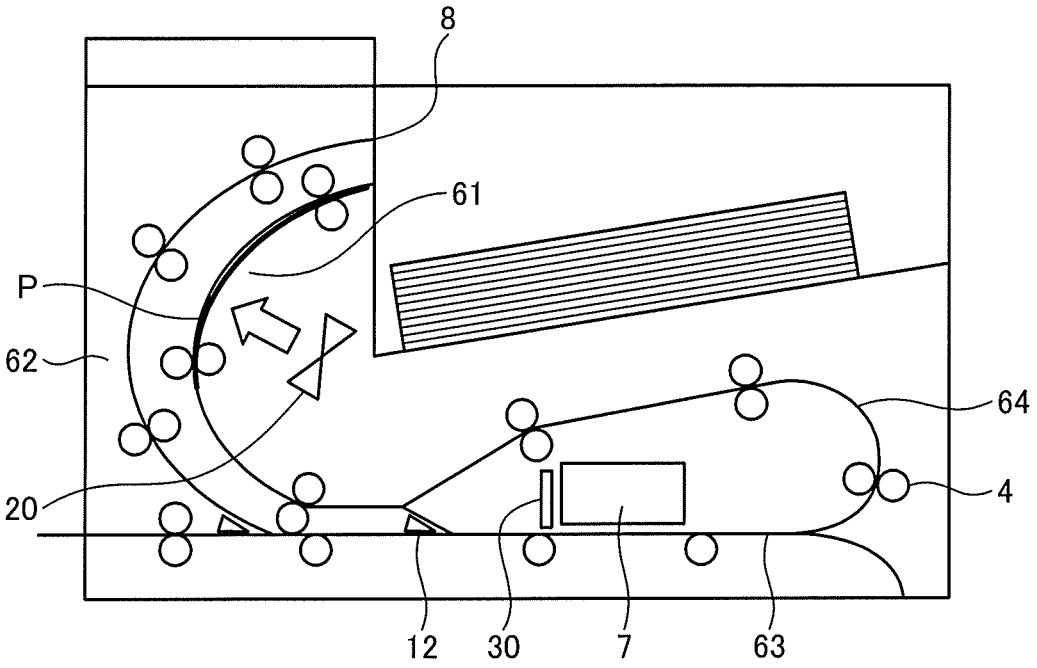
FIG. 9 is a detailed explanatory view of a conveyance path and a peripheral configuration thereof in a fifth embodiment.

Next, a fifth embodiment will be described with reference to FIG. 9.

In the present embodiment, a shield 30 is added to the above-described configuration of the first embodiment. The shield 30 is disposed so as to extend in the width direction of a sheet P on a downstream side of a liquid discharge head 7 in a conveyance direction of the sheet P. As a result, it is possible to reduce a phenomenon that drying energy (for example, air blow) of a drying device 20 is reflected and reaches the vicinity of the liquid discharge head 7 to affect discharge of a liquid.

Sixth Embodiment

Figure 10:
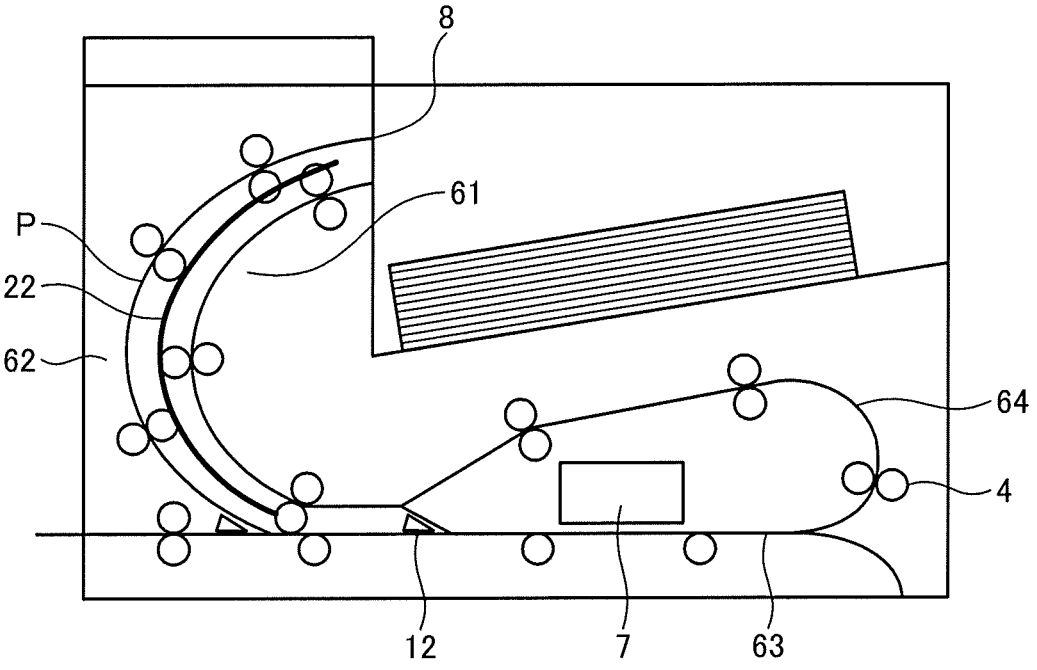
FIG. 10 is a detailed explanatory view of a conveyance path and a peripheral configuration thereof in a sixth embodiment.

Next, a sixth embodiment will be described with reference to FIG. 10.

In the present embodiment, a heating unit 22 is disposed as a drying unit as compared with each of the above-described embodiments. The heating unit 22 is disposed so as to be adjacent to both a switchback path 61 and an ejection path 62 (disposed so as to be sandwiched between the switchback path 61 and the ejection path 62). As a result, drying energy by the heating unit 22 can be supplied not only to the switchback path 61 but also to the ejection path 62, and drying can be performed more efficiently.

Seventh Embodiment

Next, a seventh embodiment will be described with reference to FIG. 11.

Figure 11:
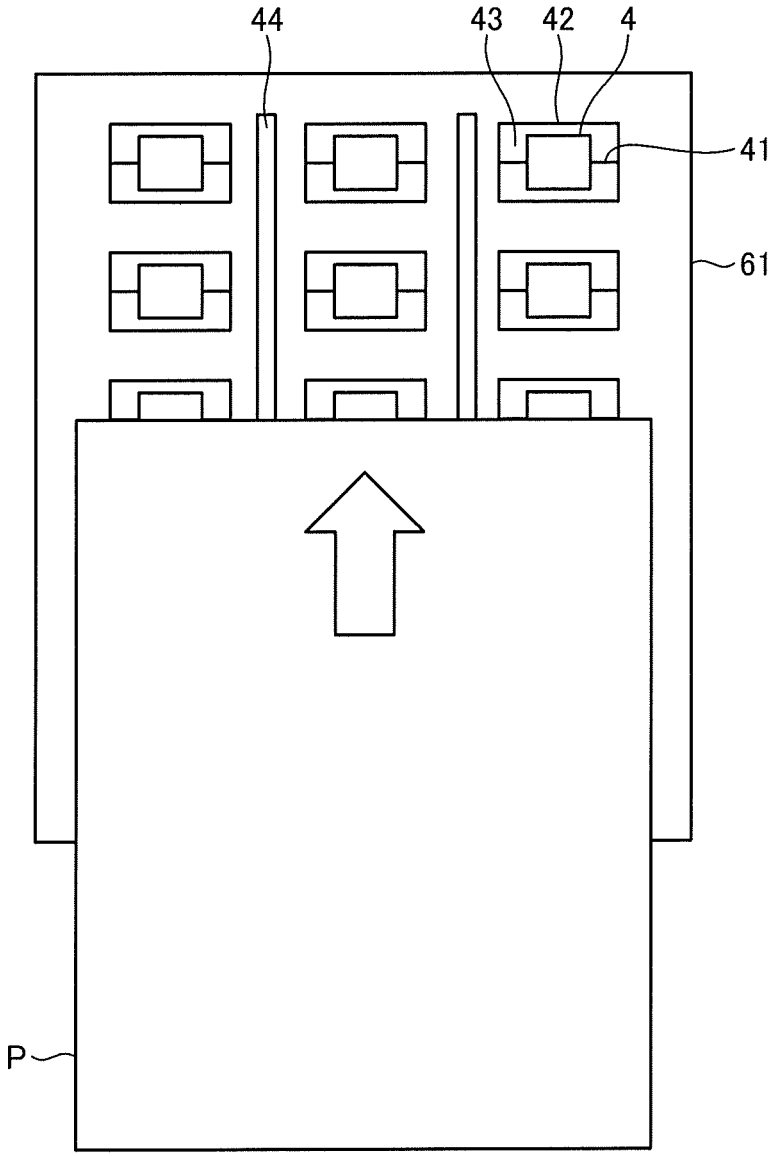
FIG. 11 is a plan view of a conveyance path in a seventh embodiment.

FIG. 11 is a plan view of a switchback path 61 (a view when viewed from a direction orthogonal to a surface of a sheet P) (curvature of the switchback path 61 is not taken into consideration).

The switchback path 61 includes the above-described conveying roller 4 and a hole 42. The hole 42 is a space for holding the conveying roller 4, and holds a shaft 41 extending from the conveying roller 4 in an inner periphery of the hole 42 to form a gap 43 between an inner wall of the hole 42 and the conveying roller 4. As a result, drying energy by a drying device 20 can pass through the hole 42 (in other words, the gap 43 which is a gap between the conveying roller 4 and the hole 42), and the drying energy can reach an ejection path 62 more efficiently.

Even if a hole 44 is separately formed in a portion not related to holding of the conveying roller 4, a similar effect can be obtained. The present configuration can be applied not only to the switchback path 61 but also to another conveyance path including the ejection path 62.

Hitherto, example embodiments of the present disclosure have been described. The present invention is not limited to the above-described embodiments as they are, and at an implementation stage, the constituent elements can be modified to embody the present invention without departing from the gist of the present invention. Various inventions can be formed by appropriately combining a plurality of constituent elements disclosed in the above embodiments. For example, some constituent elements may be deleted from all the constituent elements illustrated in the embodiments. Furthermore, the constituent elements in different embodiments may be appropriately combined with each other.

In the present application, a liquid to be discharged is not particularly limited as long as having viscosity and surface tension which makes it possible to discharge the liquid from a head. However, the liquid preferably has viscosity of 30 mPa·s or less at ordinary temperature and ordinary pressure or by heating and cooling. More specific examples of the liquid include a solution, a suspension, and an emulsion containing a solvent such as water or an organic solvent, a colorant such as a dye or a pigment, a functionalizing material such as a polymerizable compound, a resin, or a surfactant, a biocompatible material such as DNA, an amino acid, a protein, or calcium, or an edible material such as a natural dye. These liquids can be used, for example, for an inkjet ink, a surface treatment-liquid, a liquid for forming a constituent element of an electronic element or a light-emitting element or an electronic circuit resist pattern, or a three-dimensional modeling material liquid.

Examples of an energy generating source for discharging a liquid include those using a piezoelectric actuator (laminated piezoelectric element and thin film piezoelectric element), a thermal actuator using an electrothermal transducer such as a heat generating resistor, and an electrostatic actuator including a diaphragm and a counter electrode.

The "liquid discharge apparatus" includes an apparatus including a liquid discharge head or a liquid discharge unit for driving the liquid discharge head to discharge a liquid.

The liquid discharge apparatus includes not only an apparatus capable of discharging a liquid onto a liquid-attachable object but also an apparatus for discharging a liquid toward a gas or a liquid.

The "liquid discharge apparatus" may also include a means related to feeding, conveying, or ejection of a liquid-attachable object, a pretreatment device, a post-treatment device, and the like.

Examples of the "liquid discharge apparatus" include an image forming apparatus for discharging an ink to form an image on a sheet and a stereoscopic modeling apparatus (three-dimensional modeling apparatus) for discharging a modeling liquid onto a powder layer obtained by forming a powder into a layer shape in order to model a stereoscopic modeled object (three-dimensional modeled object).

The "liquid discharge apparatus" is not limited to an apparatus in which a significant image such as a letter or a graphic is visualized by a discharged liquid. Examples of the "liquid discharge apparatus" include an apparatus for forming a pattern or the like having no meaning by itself and an apparatus for modeling a three-dimensional image.

The "liquid-attachable object (medium)" means an object to which a liquid can be attached at least temporarily, and means an object causing adhesion by attachment, an object causing permeation by attachment, or the like. Specific examples of the "liquid-attachable object" include a recording medium such as a sheet, recording paper, a recording sheet, a film, or a cloth, an electronic component such as an electronic substrate or a piezoelectric element, and a medium such as a powder layer (powdery layer), an organ model, or an inspection cell. Unless particularly limited, the "liquid-attachable object" includes everything to which a liquid is attached.

A material of the "liquid-attachable object (medium)" may be any material as long as a liquid can be attached to the object even temporarily, such as paper, yarn, fiber, cloth, leather, metal, plastic, glass, wood, or ceramics.

The "liquid discharge apparatus" includes an apparatus in which a liquid discharge head and a liquid-attachable object move relatively to each other, but is not limited thereto. Specific examples thereof include a serial type apparatus for moving a liquid discharge head and a line type apparatus for not moving a liquid discharge head.

Examples of the "liquid discharge apparatus" further include a treatment liquid application apparatus for discharging a treatment liquid onto a sheet in order to apply the treatment liquid to a surface of the sheet, for example, in order to modify the surface of the sheet, and a spraying granulation apparatus for spraying a composition liquid in which a raw material is dispersed in a solution via a nozzle to granulate fine particles of the raw material.

Incidentally, in the terms of the present application, image formation, recording, letter printing, photograph printing, printing, modeling, and the like are all synonymous.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A liquid discharge apparatus, comprising:

a conveyance path on which a medium is to be conveyed;

a liquid discharge head to discharge liquid onto the medium conveyed on the conveyance path, the conveyance path including a switchback path to switch back a conveyance direction of the medium onto which the liquid has been discharged, and an ejection path to convey the medium onto which the liquid has been discharged to an ejection port; and a drying device to dry the medium both on the switchback path and on the ejection path, wherein the switchback path includes a bent portion that bends inwards towards the drying device so that the medium is bent inward, the switchback path conveys the medium while a liquid discharge surface of the medium is bent inward, and the drying device dries the medium when the medium is on the bent portion.

2. The liquid discharge apparatus according to claim 1, wherein the switchback path and the ejection path are disposed on an extension line of a supply direction of drying energy supplied by the drying device.

3. The liquid discharge apparatus according to claim 2, wherein the liquid has a water content of 50% by mass or more, and wherein the switchback path is bent to protrude in the supply direction of the drying energy supplied by the drying device.

4. The liquid discharge apparatus according to claim 2, wherein the liquid has a water content of 50% by mass or more, and wherein the ejection path is bent to protrude in the supply direction of the drying energy supplied by the drying device.

5. The liquid discharge apparatus according to claim 2, wherein, when a range to which the drying energy is supplied is referred to as a supply range Af in the ejection path and a first medium is located on the supply range Af, a second medium to be conveyed on the switchback path is located at a position not covering a whole of the supply range Af.

6. The liquid discharge apparatus according to claim 1, wherein the drying device includes a blower to blow gas.

7. The liquid discharge apparatus according to claim 6, wherein the switchback path includes:

a conveying roller to convey the medium; and a hole with a shaft supporting the conveying roller to form a gap around the conveying roller, and wherein the gas blown by the blower reaches the ejection path through the gap.

8. The liquid discharge apparatus according to claim 1, wherein the drying device includes a heating device to heat the medium.

9. The liquid discharge apparatus according to claim 8, wherein the heating device is disposed adjacent to the switchback path and the ejection path.

10. A liquid discharge apparatus, comprising:

a conveyance path on which a medium is to be conveyed;

a liquid discharge head to discharge a liquid onto the medium conveyed on the conveyance path, the conveyance path including a switchback path to switch back a conveyance direction of the medium onto which the liquid has been discharged, and an ejection path to convey the medium onto which the liquid has been discharged to an ejection port; and a heating device facing the switchback path and the ejection path, to heat the medium onto which the liquid has been discharged, wherein the switchback path includes a bent portion that bends inwards towards the heating device so that the medium is bent inward, the switchback path conveys the medium while a liquid discharge surface of the medium is bent inward, and the heating device dries the medium when the medium is on the bent portion.

11. The liquid discharge apparatus according to claim 10, wherein the heating device is disposed adjacent to the switchback path and the ejection path.

12. The liquid discharge apparatus according to claim 10, wherein the heating device is disposed to face the ejection path across the switchback path.

13. A liquid discharge apparatus, comprising:

a conveyance path on which a medium is to be conveyed;

a liquid discharge head to discharge a liquid onto the medium conveyed on the conveyance path, the conveyance path includes a switchback path to switch back a conveyance direction of the medium onto which the liquid has been discharged, and an ejection path to convey the medium onto which the liquid has been discharged to an ejection port; and a blower facing the switchback path and the ejection path, to blow gas to the medium onto which the liquid has been discharged, wherein the switchback path includes a bent portion that bends inwards towards the blower so that the medium is bent inward, the switchback path conveys the medium while a liquid discharge surface of the medium is bent inward, and the blower dries the medium when the medium is on the bent portion.

14. The liquid discharge apparatus according to claim 13, wherein the switchback path includes:

a conveying roller to convey the medium; and a hole with a shaft supporting the conveying roller to form a gap around the conveying roller, and wherein the gas blown by the blower reaches the ejection path through the gap.

15. The liquid discharge apparatus according to claim 13, wherein the blower is disposed to face the ejection path across the switchback path.

16. The liquid discharge apparatus of claim 1, wherein the switchback path has a concave shape towards the drying device and the liquid discharge head.

17. The liquid discharge apparatus of claim 1, wherein the bent portion of the switchback path bends the medium so that the medium is bent inward when receiving drying energy from the drying device.

* * * * *